US005911187A

United States Patent [19]

Sohm

[11] Patent Number: 5,911,187

[45] **Date of Patent: *Jun. 15, 1999**

[54] PONTOON

[76] Inventor: Malcolm Sohm, 6453 S. Highway 45, Oshkosh, Wis. 54901

[21] Appl. No.: 08/928,451

[22] Filed: Sep. 12, 1997

Related U.S. Application Data

[ 60] Provisional application No. 60/026,453, Sep. 12, 1996.

[51] Int. Cl.[6] ..... B63H 1/10

[52] U.S. Cl. ..... 114/61; 114/283

[58] Field of Search ..... 114/61, 283

[56] References Cited

U.S. PATENT DOCUMENTS

| | | | |
|---|---|---|---|
| 2,950,699 | 8/1960 | Ogden et al. | 114/283 |
| 2,996,030 | 8/1961 | Lornson | 114/61 |
| 3,842,785 | 10/1974 | Rivet . | |
| 3,878,803 | 4/1975 | Leverton . | |
| 4,231,131 | 11/1980 | Young | 114/61 |
| 4,777,898 | 10/1988 | Faulkner . | |
| 4,870,919 | 10/1989 | Allison | 114/61 |
| 4,988,317 | 1/1991 | Rubinsak et al. . | |
| 5,184,561 | 2/1993 | Nickell, Jr. | 114/61 |
| 5,575,231 | 11/1996 | Metcalf | 114/61 |

*Primary Examiner*—Sherman Basinger
*Attorney, Agent, or Firm*—Suiter & Associates PC

[57] ABSTRACT

A pontoon boat having a deck disposed over distal, watertight pontoons. Each pontoon comprises an elongated, generally cylindrical shell having a bow end consisting of an eccentric conical section extending upward at an angle out of the water. Splash rails, comprising fins protruding from the pontoon's shell, are disposed along the pontoon's inner and outer surfaces so that they extend substantially from the pontoon's bow end to its stern end. Each pontoon may also includes a splash guard comprising a second, larger fin mounted to the inner surface of the pontoon's shell near the its bow end. The deck of the pontoon boat includes a motor transom for mounting an outboard motor.

19 Claims, 2 Drawing Sheets

PONTOON

CROSS REFERENCE TO RELATED APPLICATIONS

The present application claims the benefit, under 35 U.S.C. § 119(e), of U.S. Provisional application Ser. No. 60/026,453, filed Sep. 12, 1996. Said Provisional application Ser. No. 60/026,453 is herein incorporated by reference in its entirety.

TECHNICAL FIELD

The present invention relates generally to water craft such as boats, ships and the like, and specifically to buoyant pontoons utilized in water craft such pontoon boats.

BACKGROUND OF THE INVENTION

Pontoon boats are popular among recreational boating enthusiasts because they provide exceptional stability in the water and are extremely rugged and durable. Typical pontoon boats comprise a horizontal, rectangular deck disposed over two distal, elongated pontoons. These pontoons are made watertight in order to provide a buoyant force allowing the boat to float in the water. Pontoon boats, however, are not the only water craft to use pontoons as floatation devices. Increasingly, designs employing pontoons are being used in larger craft such as ferries, scientific research vessels and the like where stability of the craft in the water is important.

Although stable, pontoon type water craft such as pontoon boats typically have somewhat limited handling and performance characteristics compared to other water craft such as V-hulled boats. This limited performance may become especially noticeable at higher speeds or in rough water. Consequently, it is desirable to provide an improved pontoon for use in a water craft such as pontoon boat (or ship employing a pontoon based design) which provides improved handling and increased performance at higher speeds or in rough water.

SUMMARY OF THE INVENTION

Therefore, it is an object of the present invention to provide a pontoon boat having improved handling and performance characteristics. It is another object of the present invention to provide a pontoon boat having improved control and mobility in rough water. It is a further object of the present invention to provide an improved pontoon for use with water craft such as a pontoon boat or the like to provide the water craft with improved handling and performance characteristics.

In fulfillment of these objects, the present invention provides a pontoon boat comprising a deck disposed over distal, watertight pontoons. Each pontoon preferably comprises an elongated, generally cylindrical shell having a bow end consisting of an eccentric conical bow section extending upward at an angle out of the water. Splash rails, comprising fins extending from the pontoon's shell, are affixed along the pontoon's inner and outer surfaces so that they extend substantially from the pontoon's bow end to its stern end. Similarly, a splash guard comprising a second, larger fin may be mounted to the pontoon's inner surface adjacent to the conical bow section.

BRIEF DESCRIPTION OF THE DRAWINGS

The numerous objects and advantages of the present invention may be better understood by those skilled in the art by reference to the accompanying figures of which.

DETAILED DESCRIPTION OF AN EXEMPLARY EMBODIMENT

While the invention is described herein in connection with a preferred embodiment, it will be understood it is not intended to limit the invention to this embodiment. On the contrary, it is intended to cover all alternatives, modifications and equivalents as may be included within the spirit and scope of the invention as defined by the appended claims.

Figure 1:
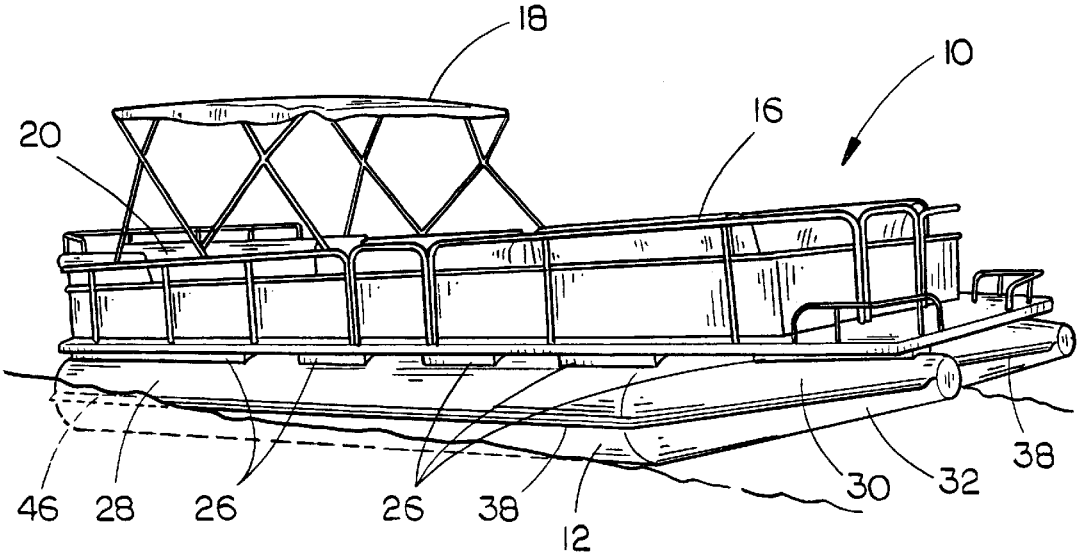
FIG. 1 is a pictorial view of a pontoon boat employing pontoons according to an exemplary embodiment of the present invention.

FIG. 1 illustrates a pontoon boat 10 employing pontoons 12 according to a preferred embodiment of the present invention. However, it will be apparent to one skilled in the art that the pontoons disclosed herein may be employed in various other water craft having designs incorporating pontoons. Such water craft may include but are not limited to larger vessels such as ferries, research vessels, and the like.

As depicted in FIG. 1, the pontoon boat 10 comprises a generally horizontal, rectangular deck 14 disposed over distal, watertight pontoons 12. The deck 14 may be made of aluminum plate, marine plywood, or the like disposed on a frame. This frame may be made of aluminum, steel, or the like. It is anticipated that typical pontoon boat accessories such as deck railing 16, a canopy 18, seats 20 and the like may be secured to the deck 14 to provide a comfortable environment to the pontoon boat's passengers. Similarly, provisions may be made for controls 22 and an outboard motor 24 (see FIGS. 2 and 3). Preferably, the deck 14 may be secured to the pontoons 12 by attachments 26 comprising box-like brackets or the like. These attachments 26, preferably made of aluminum, may be welded to the upper surfaces of the pontoons 12 and bolted to the deck 14 thus securing the deck 14 to the pontoon 12.

Figure 2:
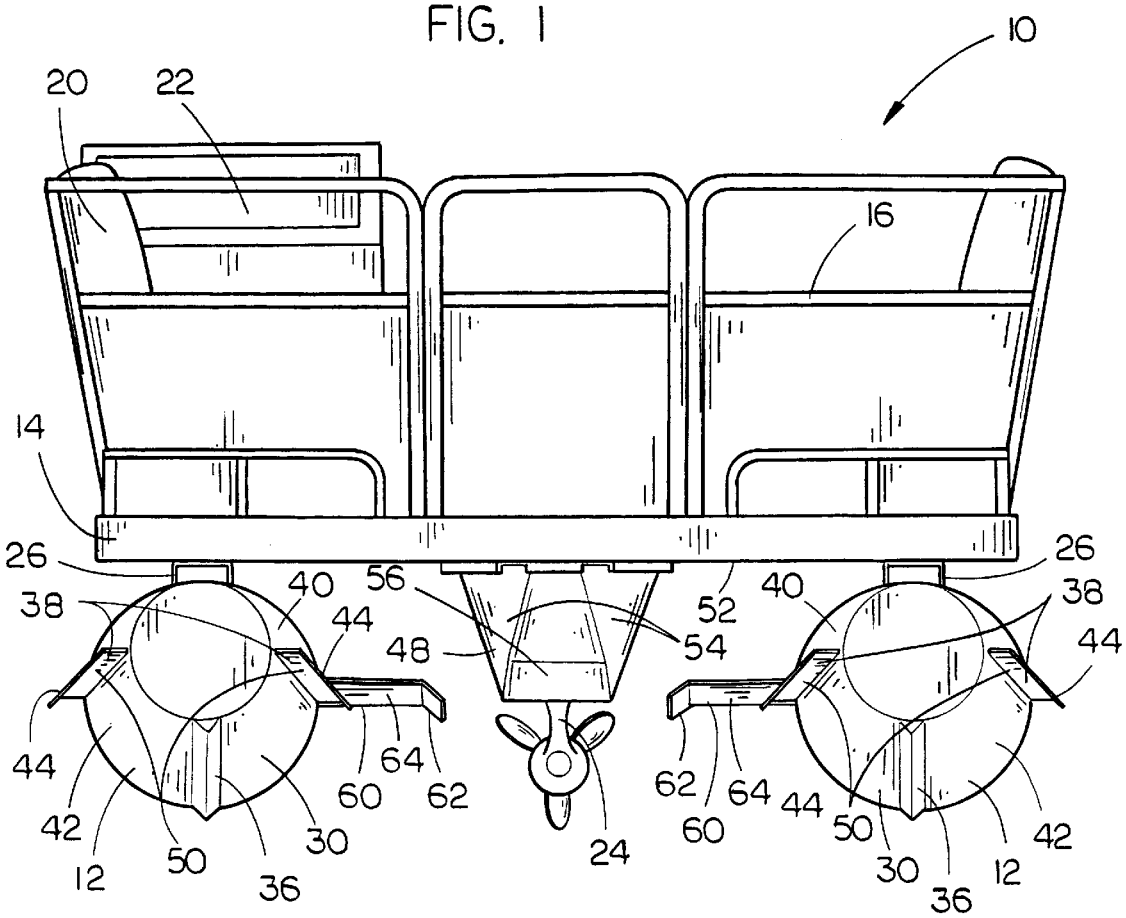
FIG. 2 is a front elevational view of the pontoon boat shown in FIG. 1.
Figure 3:
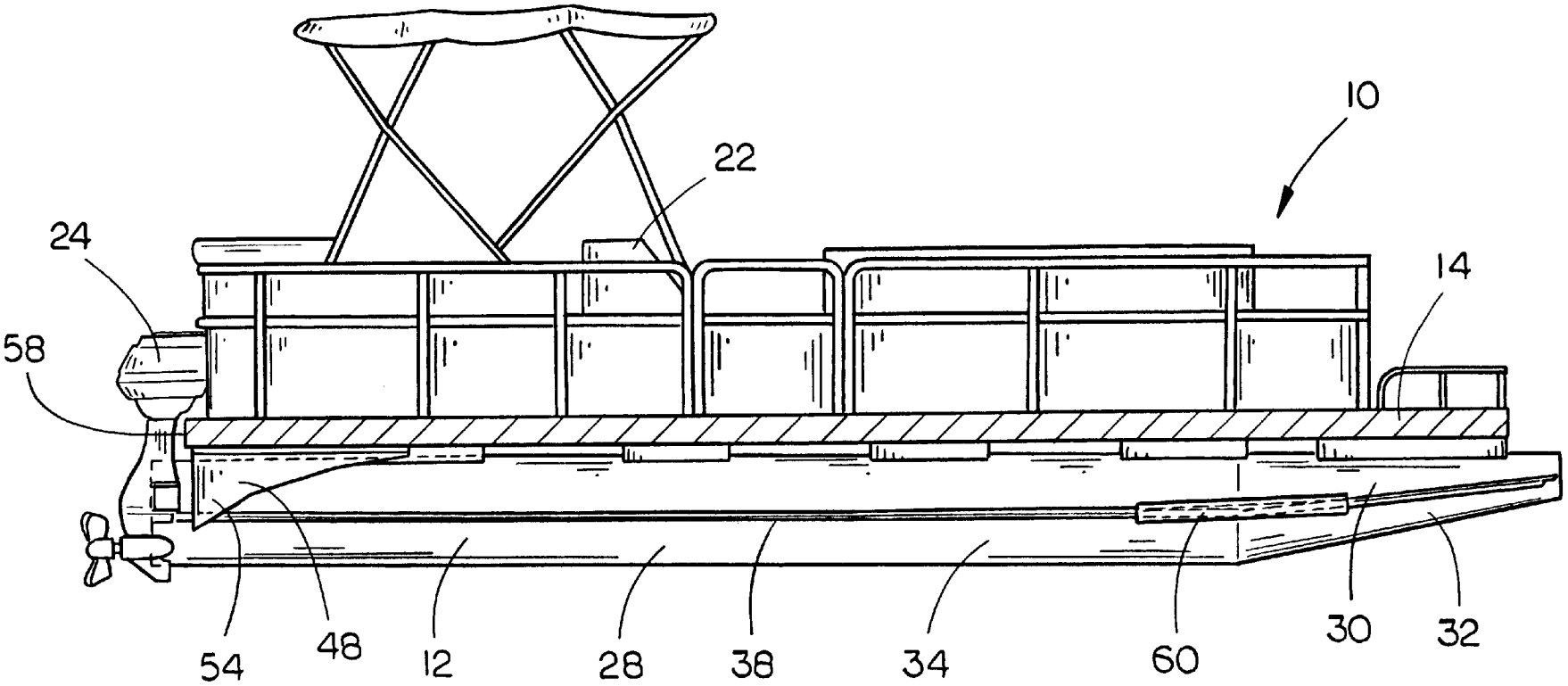
FIG. 3 is a partial cross-sectional side elevational view of the pontoon boat shown in FIG. 1, illustrating the inside surface of a pontoon according to a preferred embodiment of the present invention.

Referring now to FIGS. 1 and 3, each pontoon 12 preferably comprises an elongated, generally cylindrical shell 28 made of aluminum or the like. This shell 28 is preferably watertight to provide sufficient buoyant force to allow the pontoon boat 10 to remain afloat. In a preferred embodiment, the shell 28 may consist of several cylindrical sections of aluminum welded together. A buoyant material (not shown) may be enclosed within the shell 28 to allow the pontoon 12 to float should it become damaged or punctured. Preferably, each shell 28 includes a front or bow end consisting of an eccentric, generally conical section 30. This conical bow section 30 may have a lower surface 32 extending upward out of the water so that it forms an angle to the bottom surface of the body 34 of the pontoon 12. A V-shaped reinforcement 36 (see FIG. 2), comprising aluminum plate or the like, may be welded to the conical bow section's bottom surface to prevent damage to the pontoon 12 due to debris floating in the water, impact with the dock or another boat, and the like.

As shown in FIG. 1 through 3, Splash rails 38, comprising fins 50 extending from the pontoon's shell 28, may be mounted to the pontoon's inner and outer surfaces 40 & 42. In the preferred embodiment shown, these fins protrude horizontally along the midline of the pontoon's shell 28 and generally above the waterline of the pontoon 12. The splash rails 38 preferably extend along substantially the entire length of the pontoon from the pontoon's bow end to its stern end and may angle upward along the pontoon's conical bow section 30. The splash rail's outer edge may include a lip 44 (see FIG. 2) which is angled downward in comparison to the splash rail fin 50. This lip 44 may function to help channel water spay downward away from the pontoon 12 and deck 14. The splash rails 38 may improve performance of the pontoon 12 by channeling water away from the pontoon's shell 28 and allowing air to move under the deck 14 of the pontoon boat 10. Thus, the pontoon 12 equipped with the splash rails 38 provides a smoother ride at higher speeds or in rough water giving the pontoon boat 10 improved handling characteristics. Additionally, sections 46 of the splash rails 38 near the stem end of the pontoon 12 preferably extend into the water when the boat 10 is moving (and to some extent when the boat is stationary). These sections 46 act as a stabilizer or rudder providing improved steering capability.

FIGS. 2 and 3 also depict a motor transom 48 onto which an outboard motor 50 or the like may be mounted. The motor transom 48 functions to deflect waves as well as the wake and spray created by the pontoons 12 away from the motor 24, thus providing a smoother ride in rough water and at high speeds. This motor transom 48 may be affixed to the bottom surface 52 of the deck 14 and preferably comprises an aluminum trough having generally triangular side walls 54 extending downward from the deck 14 to a bottom wall 56. A rear wall (not shown) extends between the triangular side 54 and bottom 56 walls. This rear wall provides an attachment for the outboard motor 24. In a preferred embodiment, drain holes may be provided in the rear wall to drain water out of the motor transom 48. Preferably, the motor transom 48 extends from the middle of the deck 14, where the transom 48 is flush with the deck's bottom surface 52, to the rear edge 58 of the deck 14.

As shown in FIGS. 2 and 3, a splash guard 60 may be mounted to the inner surface 40 of each pontoon 12. This splash guard 60 preferably comprises a second, somewhat larger fin 64 mounted above the inner splash rail 38 adjacent to the conical bow section 30 of the pontoon 12. In the preferred embodiment shown, the splash guard 60 extends horizontally from the inner surface 40 of the pontoon just above its midline. The splash guard 60 may include a lip 62 which is angled downward in comparison to the horizontal splash guard fin 64. This lip 62 functions to channel water spray downward away from the pontoon 12 and deck 14 and increase airflow under the deck 14. A plurality of supports or braces (not shown) may extend between the top surface of the splash guard 60 and to the pontoon 12. These supports provide increased rigidity and support to the splash guard 60. Preferably, the splash guard 60 improves performance of the pontoon 12 by channeling water away from the pontoon's shell 28 and allowing air to move under the deck 14 of the pontoon boat 10.

In view of the above detailed description of a preferred embodiment, various modifications will now become apparent to those skilled in the art. The claims below encompass the disclosed embodiment and all reasonable modifications and variations without departing from the spirit and scope of the invention.

What is claimed is:

1. A pontoon boat comprising:

(a) at least two pontoons having bow and stem ends, inner and outer surfaces, and a horizontal midline, each of said pontoons including (i) a splash rail extending from the midline along each of the inner and outer surfaces substantially from the bow end to the stern end, and (ii) a splash guard extending horizontally from the inner surface adjacent to the bow end;

(b) a deck disposed over and secured to said at least two pontoons, wherein the splash rails and splash guards channel water spray downward away from said pontoons and said deck.

2. The pontoon boat according to claim 1 wherein each of said at least two pontoons comprises an elongated, generally cylindrical shell.

3. The pontoon boat according to claim 2 wherein said generally cylindrical shell comprises an eccentric conical section forming said bow end of said pontoon.

4. The pontoon boat according to claim 1 wherein said deck includes a motor transom for mounting an outboard motor.

5. A pontoon for providing buoyant force to float a water craft, comprising:

(a) an outer splash rail extending from a first side of said pontoon, said outer splash rail extending along the midline of said pontoon substantially from its bow end to its stern end;

(b) an inner splash rail extending from a second side of said pontoon, said inner splash rail extending along the midline of said pontoon substantially from its bow end to its stern end; and (c) a splash guard extending from the second side of said pontoon adjacent to its bow end;

(d) said inner and outer splash rails and said splash guard for channeling water spray downward away from said pontoon.

6. The pontoon according to claim 5 comprising an elongated, generally cylindrical shell.

7. The pontoon according to claim 6 wherein said generally cylindrical shell comprises an eccentric generally conical section forming said bow end of said pontoon.

8. The pontoon boat according to claim 1 wherein each splash rail comprises a fin extending horizontally from said pontoon and a lip terminating the fin and angled downward therefrom.

9. The pontoon boat according to claim 8 wherein the splash rail extends into the water near the stem end of said pontoon.

10. The pontoon boat according to claim 9 wherein the splash guard comprises a second fin extending horizontally from the inner surface of said pontoon above the splash rail and beneath said deck and a lip terminating the fin and angled downward therefrom.

11. The pontoon boat according to claim 1 wherein the splash a fin extending horizontally from said pontoon beneath said deck and a lip terminating the fin and angled downward therefrom.

12. The pontoon according to claim 5 wherein the splash rails each comprise a fin extending horizontally from said pontoon and a lip terminating the fin and angled downward therefrom.

13. The pontoon according to claim 12 wherein the splash guard comprises a second fin extending horizontally from said pontoon above said inner splash rail and a second lip terminating the second fin and angled downward therefrom.

14. The pontoon according to claim 5 wherein the splash guard comprises a fin extending horizontally from said pontoon and a lip terminating the fin and angled downward therefrom.

15. A water craft, comprising:

at least two pontoons each having a bow end and a stern end;

a deck disposed over and secured to said pontoons;

a splash rail extending longitudinally each of slid pontoons substantially from the bow end to the stem end, said splash rail positioned to be generally above the waterline of said pontoon; and a splash guard extending horizontally from the pontoon adjacent to the bow end, said splash guard positioned to be generally above the waterline of said pontoon;

wherein the splash rail and splash guard channel water spray downward away from said pontoons and said deck.

16. The water craft of claim 15 wherein the splash rail comprises a fin extending horizontally from the pontoon and a lip angled downward from the fin.

17. The water craft of claim 16 wherein the splash rail extends below the water level of the pontoon near the stem end.

18. The water craft of claim 16 wherein the splash guard comprises a second fin extending horizontally from the pontoon above the splash rail and beneath the deck and a second lip angled downward from the fin.

19. The water craft according to claim 15 wherein the splash guard comprises a fin extending horizontally from the pontoon beneath the deck and a lip angled downward from the fin.

* * * * *